US005986227A

United States Patent [19]

Hon

[11] Patent Number: 5,986,227

[45] Date of Patent: Nov. 16, 1999

[54] KEYSWITCH KEY APPARATUS

[75] Inventor: Ming-Yow Hon, Yung-Ho, Taiwan

[73] Assignee: Hon Hai Precision Ind. Co., Ltd., Taipei Hsien, Taiwan

[21] Appl. No.: 09/004,602

[22] Filed: Jan. 8, 1998

[30] Foreign Application Priority Data

Jan. 8, 1997 [TW] Taiwan ..... 86200204

[51] Int. Cl.[6] ..... H01H 3/12; H01H 13/70

[52] U.S. Cl. ..... 200/344

[58] Field of Search ..... 200/5 A, 512–517, 200/341–345

[56] References Cited

U.S. PATENT DOCUMENTS

| | | | |
|---|---|---|---|
| 4,433,225 | 2/1984 | Cowles | 200/344 |
| 5,278,371 | 1/1994 | Watanabe et al. | 200/344 |
| 5,382,762 | 1/1995 | Mochizuki | 200/5 A |
| 5,386,091 | 1/1995 | Clancy | 200/517 |
| 5,457,297 | 10/1995 | Chen | 200/344 |
| 5,466,901 | 11/1995 | Mochizuki | 200/5 A |
| 5,488,210 | 1/1996 | Shigetaka et al. | 200/344 |
| 5,769,210 | 6/1998 | Tsai | 200/344 |

*Primary Examiner*—J. R. Scott

[57] ABSTRACT

A deadlock prevention device of a keyswitch key includes a keycap and a base between which a scissors-like linkage mechanism is deformably received. The scissors-like linkage mechanism has a slidable and rotatable member formed at an intermediate portion thereof for deformation in response to a depression on the keycap. Therefore, the deadlock prevention device of the keyswitch key prevents the keyswitch key from deadlocking during operation.

18 Claims, 3 Drawing Sheets

KEYSWITCH KEY APPARATUS

BACKGROUND OF THE INVENTION

1. Field of the Invention

The present invention relates to a keyswitch key apparatus used in a computer keyboard, and particularly to a keyswitch which can prevent deadlock upon depression thereon.

2. The Prior Art

Keyboards are the most popular input devices. Each key of a conventional keyboard generally has a cap connected to a column which is surrounded by a spring thus the column can contact a base thereunder upon depression of the key. The key will return to its original position after the depression force is removed. Therefore, the key has a top-down reciprocal movement during continuous clicks. However, the column has to be moved downward at least a specific depth into the base for preventing a deadlock from occurring.

Due to the trend of increasingly compact size and portable features of the electronic markets, the above top-down structure for keys used with desk top computers can not meet the requirements of a note book computer. Therefore, a leveling mechanism as disclosed in U.S. Pat. No. 4,433,225 comprising a pair of lever arms joined at intermediate portions thereof by a pivot to form a scissors-like linkage linked to a cantilevered portion included in and fixed in a keycap is provided for replacing the conventional keycap leveling mechanism. However, a keycap block is additionally mounted in the cantilevered portion by conventional heat-staking techniques, which has two slots at two ends thereof for respectively receiving and allowing studs to extend from the two scissors-like linkage arms. However, in practice, the keycap will have a lateral displacement when it is depressed downward to substantially a half pitch of a full depression pitch. Therefore the operation of the key will cause errors due to the unwanted lateral displacement thereof. U.S. Pat. No. 5,278,371 discloses different structures for keyswitches, yet the keycaps thereof may also move laterally upon depression.

U.S. Pat. No. 5,457,297 discloses a computer keyboard key switch which includes a bottom support board, a membrane circuit supported on the support board, a key base having a rubber cone and supported on the membrane circuit, a bridging device supporting board supported on the key base, a key cap, and a bridging device connected between the key cap and the bridge device supporting board and consisting of two rectangular open frames pivotally connected in a cross arrangement for permitting the key cap to be depressed to compress the rubber cone causing it to trigger the membrane circuit. However, the assembly of the crossed, pivotal frames with the key cap and the bottom support board requires two alignments which is laborious and time inefficient.

U.S. Pat. Nos. 5,382,762 and 5,466,901 introduce spring devices connected to respective lower ends of the links which are pivotally engaged to function as a scissors-like leveling mechanism in order to provide a buffering effect to stabilize the keycap during depression. However, the structure is overly complicated requiring additional registering procedures thus complicating assembly.

Therefore, it is requisite to provide an improved and simplified structure of a keyswitch key which can prevent the keycap from deadlocking during depression.

SUMMARY OF THE INVENTION

The primary purpose of the present invention is to provide a new keyboard switch key which can remain in a satisfactory stable status during manual depression.

In accordance with one aspect of the present invention, a deadlock prevention apparatus used in a keyswitch key comprises: a keycap including a top surface from which a periphery extends downward, first rail means and second rail means formed and spaced from each other in opposite inner walls of the periphery of the keycap, and tab means extending downward from the periphery; a scissors-like linkage mechanism having first end portion means slidably retained in the first rail means and the second rail means of the keycap, intermediate pivoting and sliding portion means providing a rotatable and slidable movement for the scissors-like linkage mechanism when the scissors-like linkage mechanism is deformed due to an external force acting on the keycap, and second end portion means; and a base including socket means projecting upward therefrom for slidably receiving the tab means of the keycap and retaining means formed thereon for pivotally receiving the second end portion means of the scissors-like linkage mechanism.

In accordance with another aspect of the present invention, a deadlock prevention apparatus used in a keyswitch key is provided and installed with an elastic device engaged therein to return the keyswitch key to an original undepressed level upon release from a depression. The deadlock prevention apparatus comprises: a keycap including a top surface from which a periphery extends downward, first rail means and second rail means formed and spaced from each other in opposite inner walls of the periphery of the keycap, and tab means extending downward from the periphery of the keycap; a scissors-like linkage mechanism comprising first pivotable arm means and second pivotable arm means being rotatably and slidably connected with respect to each other at substantially intermediate portions thereof; upper end portion means and lower end portion means of the first pivotable arm being respectively formed at two distal ends thereof, and the upper end portion means of the first pivotable arm being slidably received in the first rail means; upper end portion means and lower end portion means of the second pivotable arm being respectively formed at two distal ends thereof, and the upper end portion means of the second pivotal arm being slidably received in the second rail means; and a base including socket means projecting upward therefrom for slidably receiving the tab means of the keycap, first retaining means and second retaining means formed thereon for respectively and pivotally receiving the lower end portion means of the first pivotable arm and the lower end portion means of the second pivotable arm. Whereby the first rail means of the keycap vertically registers with the second retaining means of the base and the second rail means of the keycap vertically registers with the first retaining means of the base, and whereby the first pivotable arm and the second pivotable arm rotate and slide with respect to each other when a depression force is applied to or released from the keycap.

DETAILED DESCRIPTION OF THE PREFERRED EMBODIMENTS

Figure 1:
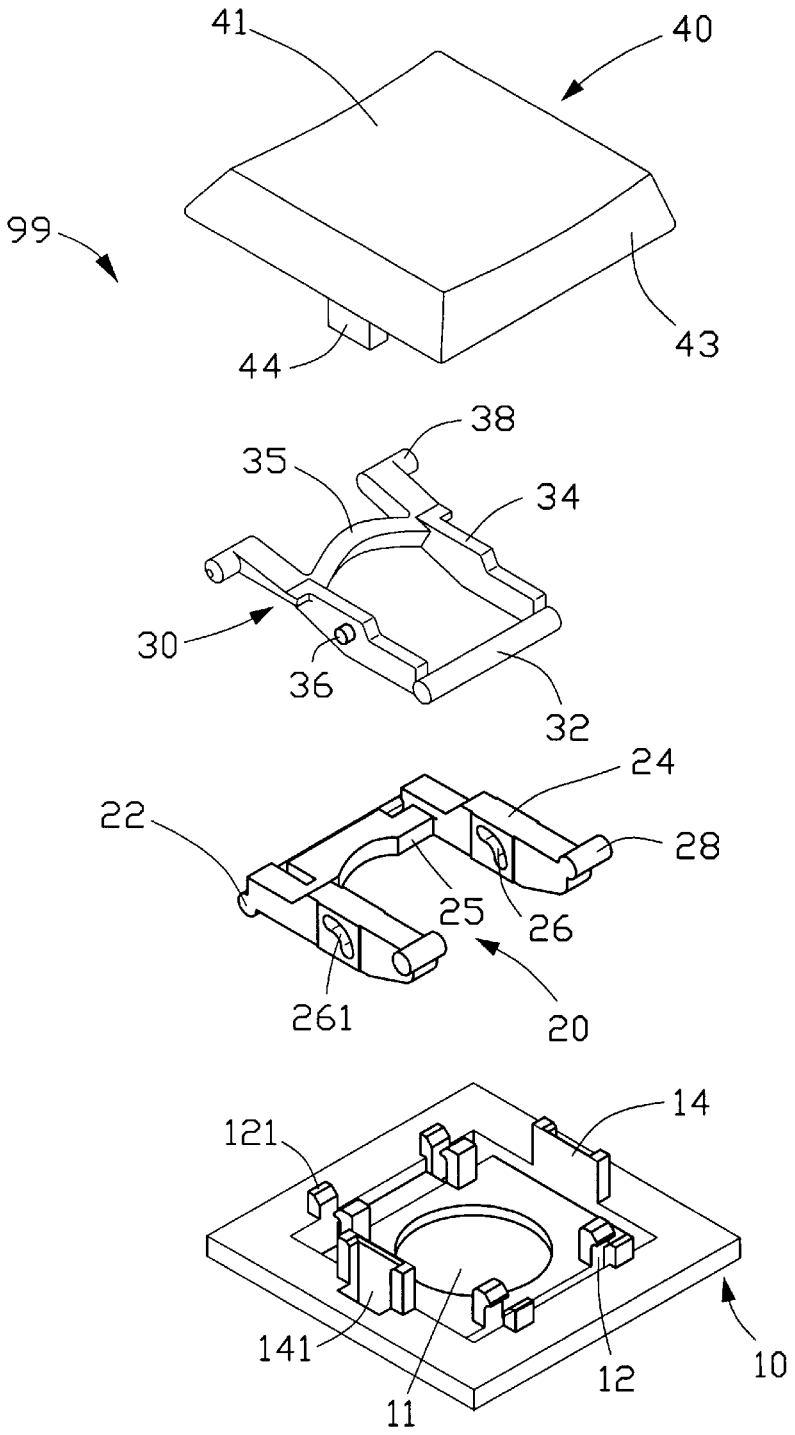
FIG. 1 is an exploded view of a keyswitch key in accordance with the present invention.

Referring to the drawings and initially to FIG. 1, a keyswitch key 99 in accordance with the present invention comprises a base 10, first pivotable arm means 20, second pivotable arm means 30, and a keycap 40. The base 10 is a square structure defining a hole 11 in a central portion thereof, four retaining members 12 are formed around the hole 11 and arranged as two parallel in-line pairs, and two sockets 14 are formed around the hole 11 opposite each other.

Each retaining member 12 comprises two tabs 121 projecting upward and spaced from each other a predetermined distance for rotatably receiving a portion of the first pivotable arm means 20 and the second pivotable arm means 30 which will be described later in more detail. Each socket 14 has a substantially U-shaped wall projecting upward from the base 10 thus defining a guiding passage 141 therein.

The first pivotable arm means 20 is substantially a U-shaped arm including a bridging portion 22 pivotably received in the two in-line retaining members 12 of the base 10 and two parallel branches 24 connected by the bridging portion 22. The first pivotable arm means 20 is rotatable when the bridging portion 22 is pivotally retained in the in-line pair of retaining members 12. The bridging portion 22 is a rod integrated with a plate 25 which is connected to the intermediates of the rod and the two parallel branches 24 of the U-shaped arm 20. The integrated plate 25 functions as a reinforce for strengthening the rod 22.

Each branch 24 of the U-shaped arm 20 defines a hole 26 in an intermediate thereof. The hole 26 is substantially elliptical and defined by a curved periphery wall 261. A first pair of rods 28 extends from each end of the parallel branches 24.

The second pivotable means 30 comprises a bridging portion 32 pivotably received in the two in-line retaining members 12 of the base 10 which are not already engaged with the first pivotable arm means 20. Two parallel branches 34 are connected to two distal ends of the bridging portion 32 and a reinforcing rib 35 is interconnected to intermediates of the parallel branches 34 for strengthening the second pivotable arm means 30. Two pins 36 respectively extending outward from intermediates of the parallel branches 34 are pivotably and slidably received in the corresponding holes 26 of the parallel branches 24 of the U-shaped arm 20. A second pair of rods 38 extends laterally from two distal ends of the parallel branches 34.

Figure 2:
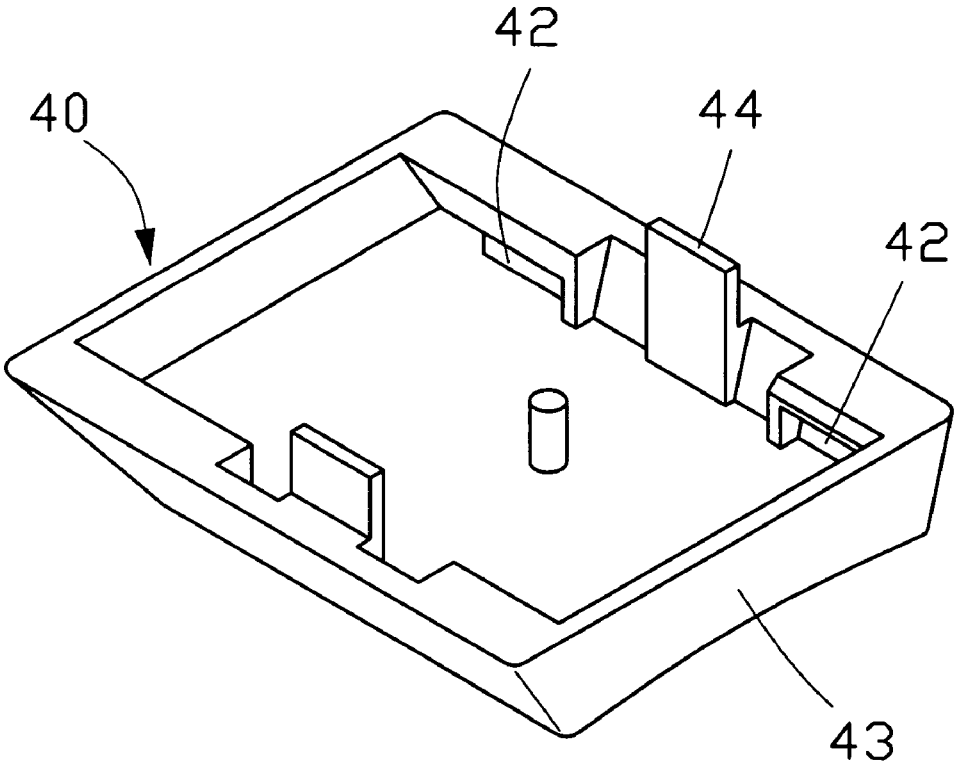
FIG. 2 is a perspective view of an underside of a keycap of the keyswitch key of the present invention.

Referring also to FIG. 2, the keycap 40 comprises a depression surface 41 for receiving a manual depression from a user and a periphery 43 extending downward from each side of the depression surface 41. Four rail members 42 are respectively formed in two opposite inner walls of the periphery 43 substantially near four inner corners of the keycap 40. The rail members 42 are arranged in two parallel in-line pairs. Each rail member 42 is vertically positioned to register with a corresponding one of the retaining members 12 of the base 10 when the keycap 40 is assembled with the base 10. Each rail member 42 is a substantially L-shaped wall extending from a corresponding inner wall portion of the periphery 43 for slidably receiving one of the corresponding rods 28, 38 of the first and second pivotable arm means 20, 30. Two tabs 44 respectively extending downward from intermediate portions of opposite inner walls of the periphery 43 are slidably and vertically retained within the sockets 14 of the base 10.

Figure 3:
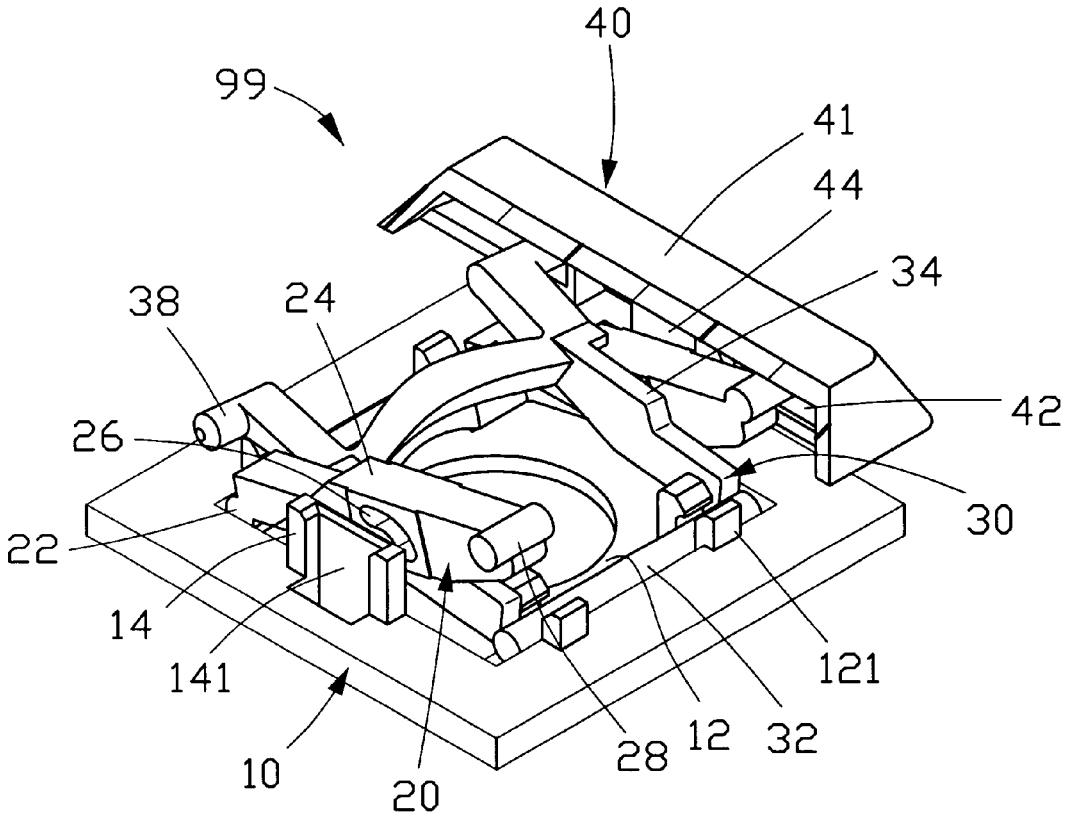
FIG. 3 is a perspective view of the assembled keyswitch key wherein a large portion of the keycap has been cut away to clearly show other components of the keyswitch key.

Referring to FIG. 3, the first pair of rods 28 of the first pivotable arm means 20 are slidably retained in the first pair of rails 42 formed in opposite inner walls of the periphery 43 of the keycap 40, while the bridging portion 22 of the first pivotable arm means 20 is rotatably received in one of the in-line pairs of retaining members 12. The second pair of rods 38 of the second pivotable arm means 30 is slidably retained in the second pair of rails 42 formed in opposite inner walls of the periphery 43 of the keycap 40, while the bridging portion 32 of the second pivotable arm means 30 is rotatably received in the other in-line pair of retaining members 12. The pins 36 (not shown in this figure) of the second pivotable arm means 30 are rotatably and slidably received in the elliptical holes 26 of the first pivotable arm means 20. Therefore the first and second pivotable arm means 20, 30 together constitute a scissors-like linkage mechanism for deformation of the shape thereof after receiving a manual depression on the keycap 40. With the above structure, the keyswitch key 99 can remain in a workable status without deadlocking when the keycap 40 thereof is depressed. This is because the rods 28, 38 can freely slide along the rails 42, the bridging portions 22, 32 can rotate within the retaining members 12, and the pins 36 can rotate and smoothly slide in the holes 26 upon depression of the keycap 40. Since the hole 26 is a elliptical hole 26 and defined by the curved periphery wall 261, when the scissors-like linkage mechanism formed by the two pivitable arm means 20, 30 is depressed by the keycap 40 due to an external click, the pins 36 can accordingly rotate and slide in the holes 26 thus preventing deadlock from occurring in the intermediate engagement section of the scissors-like linkage mechanism 20, 30.

Alternatively, the elliptic holes 26 may be replaced with elliptical grooves (not shown) provided that the pins 36 may rotate and slide smoothly in the grooves. In addition, the pins 36 may be formed on the first sliding member 20 and the holes 26 may be defined in the second sliding member 30. Since these modifications quite simple, the drawings thereof are omitted herein.

At least an elastic device, such as a spring or rubber (not shown) with a contact portion attached at the bottom end thereof, is installed under the keycap 40 in the free space of the scissors-like linkage mechanism of the first and second pivotable arm means 20, 30, thus when the keycap 40 is depressed with at least a predetermined force, the contact portion will pass through the hole 11 of the base 10 and press a well known printed circuit board (not shown) under the base 10. Since the elastic device and the contact portion are well known, they are omitted herein for simplification of the drawings.

Therefore, the keyswitch key 99 will not have a deadlocking problem upon release of depression, i.e., the keyswitch key 99 will return to its original undepressed position due to elasticity from the elastic device (not shown) without deadlocking for the same reason as previously mentioned.

While the present invention has been described with reference to a specific embodiment, the description is illustrative of the invention and is not to be construed as limiting the invention.

Therefore, various modifications to the present invention can be made to the preferred embodiment by those skilled in the art without departing from the true spirit and scope of the invention as defined by the appended claims.

What is claimed is:

1. A deadlock prevention apparatus used in a keyswitch key comprising:

a keycap including a top surface from which a periphery extends downward, first rail means and second rail means formed and spaced from each other in opposite inner walls of the periphery of the keycap, and tab means extending downward from the periphery;

a scissors-like linkage mechanism having first end portion means slidably retained in the first rail means and the second rail means of the keycap, intermediate pivoting and sliding portion means extending from the first end portion means and providing a rotatable and slidable movement for the scissors-like linkage mechanism when the scissors-like linkage mechanism is deformed due to an external force acting on the keycap, and second end portion means extending from the intermediate pivoting and sliding portion means; and a base including socket means projecting upward therefrom for slidably receiving the tab means of the keycap and retaining means formed thereon for pivotably receiving the second end portion means of the scissors-like linkage mechanism.

2. The deadlock prevention apparatus as claimed in claim 1, wherein the first rail means of the keycap comprises two rail portions projecting from opposite inner wall portions of the keycap.

3. The deadlock prevention apparatus as claimed in claim 1, wherein the first end portion means comprises first pin means perpendicularly extending from end portions thereof and slidably retained in the first rail means.

4. The deadlock prevention apparatus as claimed in claim 1, wherein the second end portion means of the scissors-like mechanism comprises two rods separated from each other with a predetermined distance and respectively and rotatably received in separated portions of the retaining means of the base.

5. A deadlock prevention apparatus used in a keyswitch key which is installed with an elastic device engaged therein to return the keyswitch key to an original undepressed level upon release from a manual depression, the deadlock prevention apparatus comprising:

a keycap including a top surface from which a periphery extends downward, first rail means and second rail means formed and spaced from each other in opposite inner walls of the periphery of the keycap, and tab means extending downward from the periphery;

a scissors-like linkage mechanism comprising first pivotable arm means and second pivotable arm means being rotatably and slidably connected with respect to each other at intermediate portions thereof;

upper end portion means and lower end portion means of the first pivotable arm means being respectively formed at two distal ends thereof, and the upper end portion means of the first pivotable arm means being slidably received in the first rail means;

upper end portion means and lower end portion means of the second pivotable arm means being respectively formed at two distal ends thereof, and the upper end portion means of the second pivotable arm means being slidably received in the second rail means; and a base including socket means projecting upward therefrom for slidably receiving the tab means of the keycap, first retaining means and second retaining means formed thereon for respectively and pivotably receiving the lower end portion means of the first pivotable arm means and the lower end portion means of the second pivotable arm means;

whereby the first rail means of the keycap vertically registers with the second retaining means of the base and the second rail means of the keycap vertically registers with the first retaining means of the base, and whereby the first pivotable arm means and the second pivotable arm means rotate and slide with respect to each other when a depression force is applied to or released from the keycap.

6. The deadlock prevention apparatus as claimed in claim 5, wherein the first rail means comprises two rail portions each of which is a substantially L-shaped protrusion projecting from the inner wall portion of the keycap.

7. The deadlock prevention apparatus as claimed in claim 5, wherein the first pivotable arm means is a U-shaped arm.

8. The deadlock prevention apparatus as claimed in claim 7, wherein the upper end portion means of the first pivotable arm means are two rods extending perpendicularly from two parallel branch ends of the U-shaped arm and slidably received in the first rail means of the keycap.

9. The deadlock prevention apparatus as claimed in claim 8, wherein the lower end portion means of the U-shaped first pivotable arm means is connected between two parallel branches of the U-shaped arm and rotatably received in the first retaining means of the base.

10. The deadlock prevention apparatus as claimed in claim 9, wherein the lower end portion means of the U-shaped first arm means is a rod.

11. The deadlock prevention apparatus as claimed in claim 10 further comprising a reinforce connected to an intermediate of the rod of the lower end portion means and the two parallel branches.

12. The deadlock prevention apparatus as claimed in claim 11, wherein the reinforce is substantially a plate.

13. The deadlock prevention apparatus as claimed in claim 5, wherein the first pivotable arm means defines reception means therein and the second pivotable arm means comprises pin means slidably and rotatably received in the reception means of the first pivotable arm means.

14. The deadlock prevention apparatus as claimed in claim 13, wherein the reception means defines at least one hole.

15. The deadlock prevention apparatus as claimed in claim 5, wherein the tab means comprises at least one tab and the socket means comprises corresponding number of sockets to the at least a tab for slidably receiving the at least a tab.

16. The deadlock prevention apparatus as claimed in claim 5, wherein the first retaining means of the base comprises at least a pair of protrusions with a space therebetween for pivotably receiving the lower portion means of the first pivotable arm.

17. The deadlock prevention apparatus as claimed in claim 10, wherein the first retaining means of the base comprises at least a pair of protrusions with a space therebetween for pivotably receiving the rod of the U-shaped arm.

18. A keyswitch key for use with a keyboard of a computer, comprising:

a keycap defining first means extending downward therefrom for guidance of vertical movement;

a first and a second pivotal arms rotatably and slidably connected to each other at intermediate portions thereof; and a base defining second means registered with the first means and movably receiving the first means for guidance of vertical movement of the keycap with respect to the base;

retaining means formed on one of the keycap and the base, and rail means formed on the other of the keycap and the base; wherein at least an end portion of one of said first and second pivotal arms is rotatably received within said retaining means, and an opposite end-portion thereof is slidable along said rail means whereby said one pivotal arm can be rotated about the retaining means.

* * * * *